US012089740B1

(12) United States Patent
Davis et al.

(10) Patent No.: US 12,089,740 B1
(45) Date of Patent: Sep. 17, 2024

(54) VERTICAL MOUNT SYSTEM

(71) Applicant: Silicate Studio Home, LLC, Rexburg, ID (US)

(72) Inventors: Steve Davis, Rexburg, ID (US); Riley Plocher, Rexburg, ID (US); Jeff Ward, Rexburg, ID (US)

(73) Assignee: Silicate Studio Home, LLC, Rexburg, ID (US)

( * ) Notice: Subject to any disclaimer, the term of this patent is extended or adjusted under 35 U.S.C. 154(b) by 0 days.

(21) Appl. No.: 18/302,365

(22) Filed: Apr. 18, 2023

(51) Int. Cl.
*A47B 96/14* (2006.01)

(52) U.S. Cl.
CPC ..... *A47B 96/1475* (2013.01)

(58) Field of Classification Search
CPC ..... A47B 96/1475; F16M 13/02
USPC ..... 248/201, 475.1
See application file for complete search history.

(56) References Cited

U.S. PATENT DOCUMENTS 6,305,892 B1 * 10/2001 Qiao ..... H04R 1/025 411/510
6,520,704 B1 * 2/2003 Vidmar ..... F16B 35/06 403/279
7,708,252 B2 * 5/2010 Vander Berg ..... A47G 1/1606 248/475.1
10,472,127 B2 * 11/2019 Koelling ..... B65D 21/0202
11,013,326 B2 * 5/2021 Graber ..... A47B 95/008
11,786,060 B1 * 10/2023 Ward ..... G09F 7/18 248/489
2022/0312964 A1 * 10/2022 Kressin ..... A47B 96/066

FOREIGN PATENT DOCUMENTS

DE 102011112029 3/2013

* cited by examiner

*Primary Examiner* — Todd M Epps
(74) *Attorney, Agent, or Firm* — Thorpe North & Western, LLP

(57) ABSTRACT

A vertical mount system for wall hangings comprises a wall mounting fastener alignment plate with an array of apertures to align with a vertical array of wall anchors in the wall and secured by a vertical array of double-headed fasteners. The double-headed fasteners extend through the apertures in the alignment plate and into the wall anchors. The alignment plate positions the wall anchors with respect to the wall. A mounting rail is attached to the alignment plate by the double-headed fasteners. A recess in the rear of the mounting rail receives the alignment plate therein. An array of key-holes in the mounting rail receives outer heads of the double-headed fasteners.

20 Claims, 10 Drawing Sheets

VERTICAL MOUNT SYSTEM

PRIORITY CLAIM(S) AND RELATED APPLICATION(S)

This is related to U.S. patent application Ser. No. 18/302,582, filed Apr. 18, 2023, entitled "Shelf System for Vertical Mounts", which is hereby incorporated herein by reference.

BACKGROUND

Items, such as shelves, can be attached to walls using various support structures, such as brackets. Some support structures for wall-mounted shelves have a utilitarian appearance that can be aesthetically displeasing. A consumer may find visible support structures on a wall to be undesirable in a room where the consumer wishes to establish a certain décor. Improvement to shelves and brackets is an ongoing endeavor.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1A:
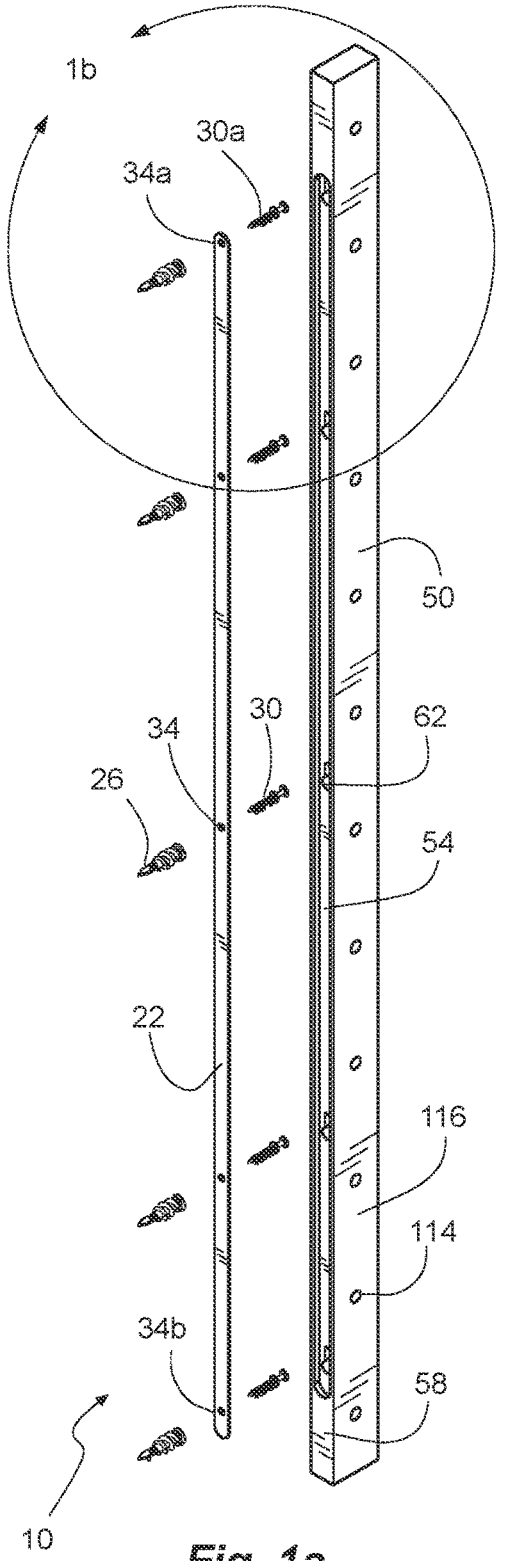
FIG. 1*a* is an exploded perspective view of a vertical mount system in accordance with an embodiment of the invention.
Figure 1B:
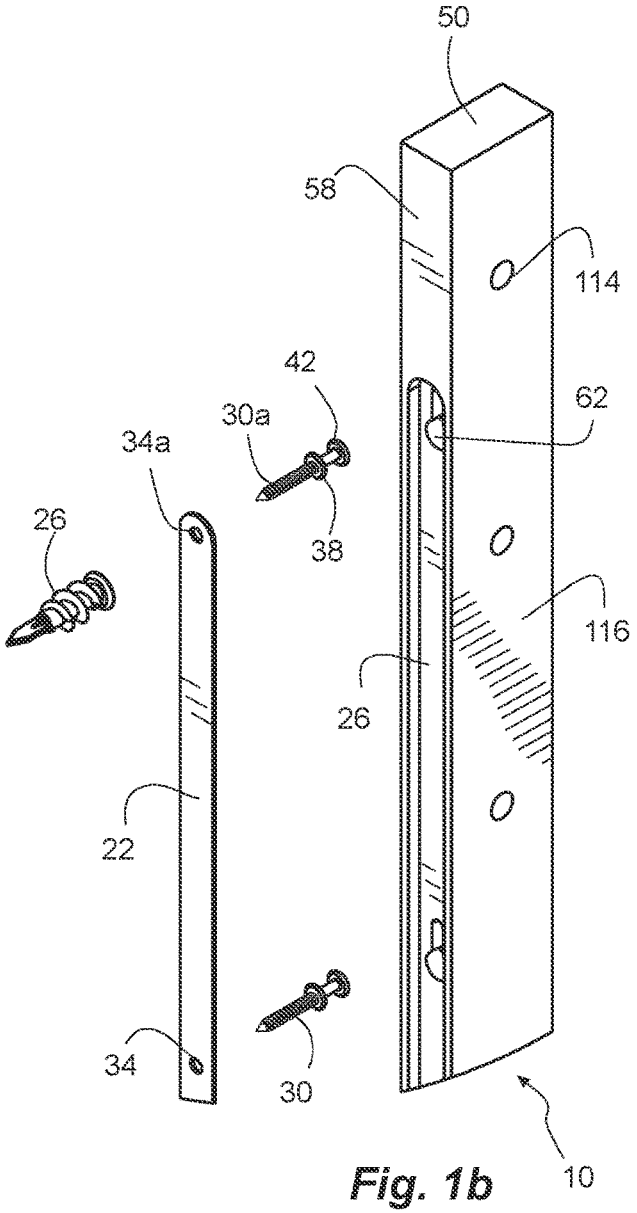
FIG. 1*b* is a partial, detailed, exploded view of the vertical mount system of FIG. 1*a*.
Figure 2:
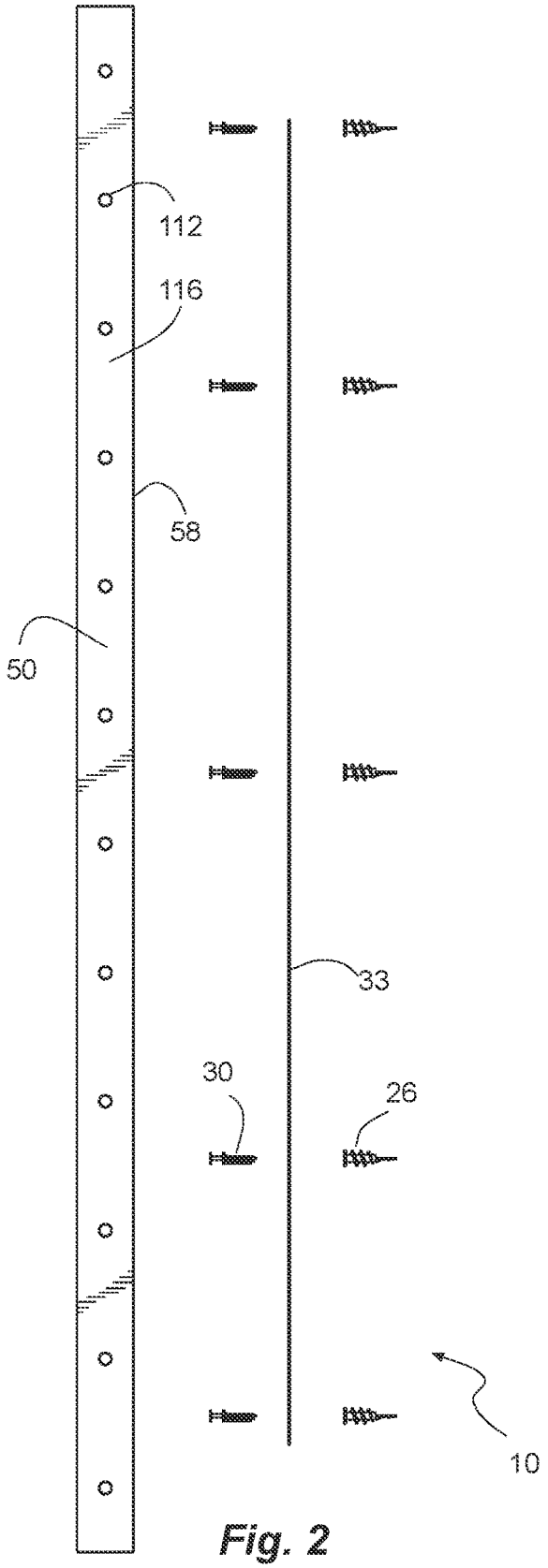
FIG. 2 is an exploded side view of the vertical mount system of FIG. 1*a*.
Figure 3:
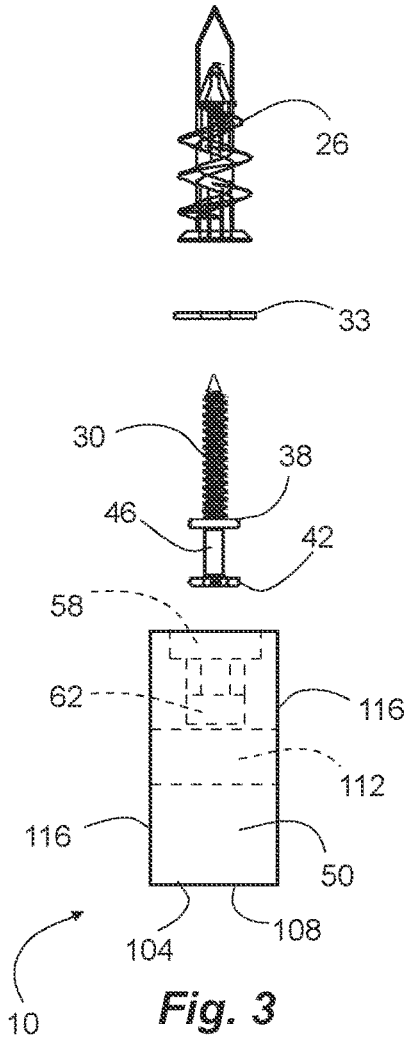
FIG. 3 is an exploded top view of the vertical mount system of FIG. 1*a*.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

An initial overview of the inventive concepts is provided below and then specific examples are described in further detail later. This initial summary is intended to aid readers in understanding the examples more quickly, but is not intended to identify key features or essential features of the examples, nor is it intended to limit the scope of the claimed subject matter.

A mount system can be provided for mounting wall hangings, such as shelves, to a flat vertical surface, such as a wall. The mounting system can provide an alignment plate to align wall mounting fasteners, such as wall anchors and/or double-headed fasteners, with the wall in correct locations. In addition, the mount system can have a mounting rail to cover and conceal the alignment plate so that the mounting hardware is not conspicuously visible.

Sometimes shelves can require mounting hardware, such as screws, nails and drywall anchors. Hanging shelves can sometimes require measuring mounting locations and checking for level. Sometimes the mounting hardware can be mis-installed, resulting in remounting and wall damage. For example, a hole or fastener location can be mis-measured or off-level; resulting in a hole in the drywall that needs to be patched and another, correct location determined.

In one aspect, the mounting system presented herein can be vertically oriented to help with level. The mounting plate presented herein can engage the wall from a top end with the remaining mounting plate hanging vertical and plumb. In addition, the mounting plate can have an array of holes. With the mounting plate against the wall, the array of holes can be used to mark the wall for the location of fasteners, such as wall anchors and/or double-headed fasteners. In addition, the array of holes can correspond to an array of keyholes in a mounting rail. Thus, the fasteners can correctly match the location of the keyholes in the mounting rail. The mounting rail can have a rear recess to receive and conceal the mounting plate. The mounting plate can remain with the fasteners and the wall to provide additional strength to the mounting system against the wall.

In another aspect, the mounting rail can provide lateral bores to receive fasteners to mount the wall hanging or shelves to the mounting rail, and thus the wall. The lateral bores can be provided along a length or height of the mounting rail to provide multiple different locations for the wall hanging or shelves to be positioned, and thus a variety of shelving configurations can be possible. Positioning the lateral bores in the lateral sides of the rails can make the lateral bores less conspicuous and can even conceal the lateral bores. The mounting rail can have a solid front face with a continuous surface. Thus, the mounting of the wall hanging or shelves to the mounting rail can be inconspicuous.

In addition, a shelf system can be associated with the mount system and mounted to the wall. The shelf system can have shelves that can mount to the mounting rail. Each shelf can have lateral apertures to align with the lateral bores of the mounting rail to receive fasteners therethrough. In one aspect, the shelves can have high lateral sides to conceal all or many or the bores so that they are inconspicuous.

In another aspect, the shelves can be formed of a single sheet of material. The shelf can have bends that create orthogonal planes to strengthen the shelf.

In another aspect, various different shelves can be provided with different horizontal widths and depths to provide a variety of options.

Referring to FIGS. 1*a*-11, a mounting system 10 for mounting wall hangings, such as shelves 14 (FIGS. 8-11), to a wall 18 (FIG. 4*b*) in an example of the invention is shown. The wall hangings can comprise shelves, pictures, paintings, shadow boxes, tapestries, etc. In one aspect, the mounting system 10 can be vertical, or oriented vertically, to engage lateral sides of the wall hangings and shelves 14. The vertical orientation of the mounting system 10 can facilitate achieving level or plumb because the system 10 can hang vertically under the force of gravity to achieve plumb.

The mounting system 10 can have a wall mounting fastener alignment plate 22 for aligning wall mounting fasteners, such as wall anchors 26 and/or double-headed fasteners 30, with the wall 18. The alignment plate 22 can be elongated with a height much greater than a width and a thickness or depth. The alignment plate 22 can be vertically oriented with respect to the wall 18. A plurality of apertures 34 can be vertically arrayed along the height of the alignment plate 22. In one aspect, an uppermost aperture 34*a* can be positioned at a top of the alignment plate 22. Similarly, a lowermost aperture 34*b* can be positioned at a bottom of the alignment plate 22. In one aspect, the alignment plate 22 can be oriented with either end up and with either aperture 34*a* or 34*b* defining the uppermost aperture 34*a*. In one aspect, the alignment plate 22 can be hung pendent from the uppermost aperture 34*a* to achieve plumb. In another aspect, the alignment plate 22 can be formed of metal, and can be formed by cutting bar stock to length and drilling or punching the apertures.

The mounting system 10 can also have a plurality of wall anchors 26 that correspond to the array of apertures 34. In one aspect, the wall anchors 26 can be drywall anchors with an aperture to receive a double-headed fastener 30. In another aspect, the wall anchors 26 can have a self-driving auger and can be longitudinally bifurcated to separate behind the drywall of the wall 18. In addition, the wall anchors 26 can have an enlarged head that abuts to the face of the wall 18. The wall anchors 26 can be secured to the wall 18 and arranged in a vertical array of wall anchors 26. The array of apertures 34 of the alignment plate 22 can be used to mark locations on the wall 18 for installing the wall anchors 26, as described herein. The apertures 34 of the alignment plate 22 can position the plurality of wall anchors 26 with respect to the wall 18 in the vertical array of wall hangers 26.

In one aspect, the alignment plate 22 can be positioned and oriented against a surface of the wall 18. When properly placed, the apertures 34 of the alignment plate 22 can be used to mark the locations for the wall anchors 26. For example, a marker can be inserted into the apertures 34 to mark the wall 18.

In one aspect, the wall anchors 26 can be pressed and screwed into the drywall of the wall 18 with the auger advancing the wall anchor 26 into the drywall. In another aspect, the wall anchors 26 can be inserted into pre-drilled holes in the wall 18. In another aspect, the double-headed fasteners 30 can attach directly to the wall 18 through the apertures 34 of the alignment plate 22.

Figure 4A:
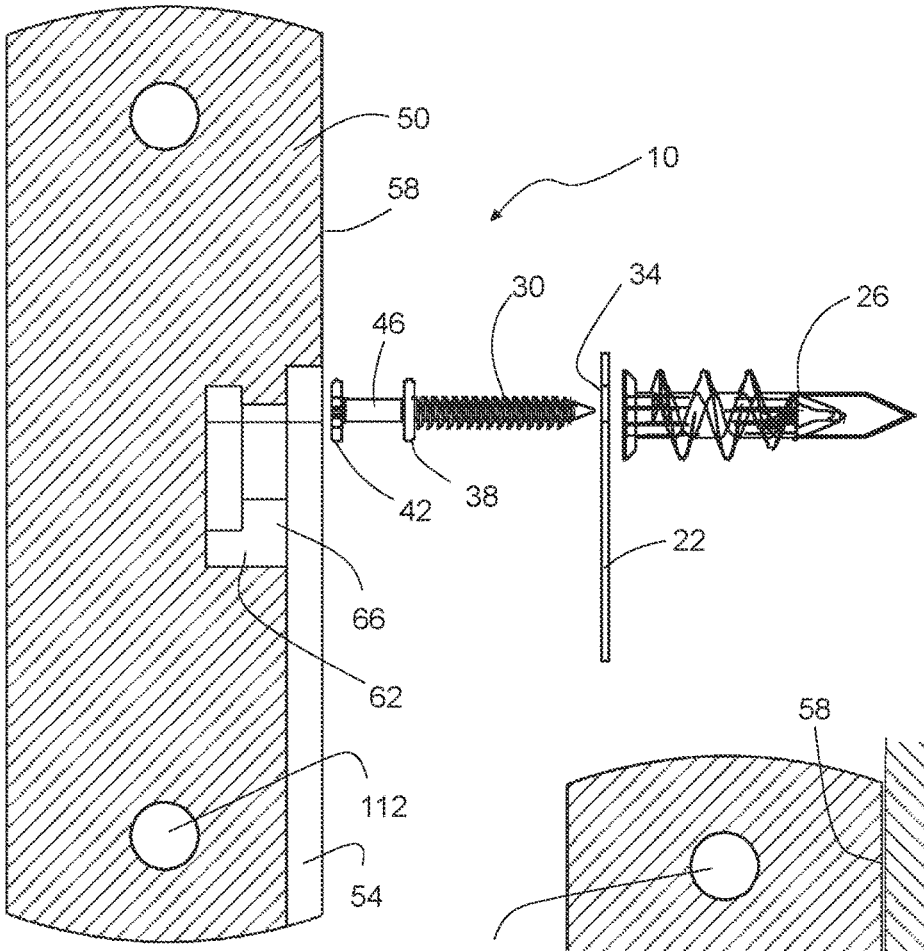
FIG. 4*a* is a cross-sectional, exploded, side schematic view of the vertical mount system of FIG. 1*a*.
Figure 4B:
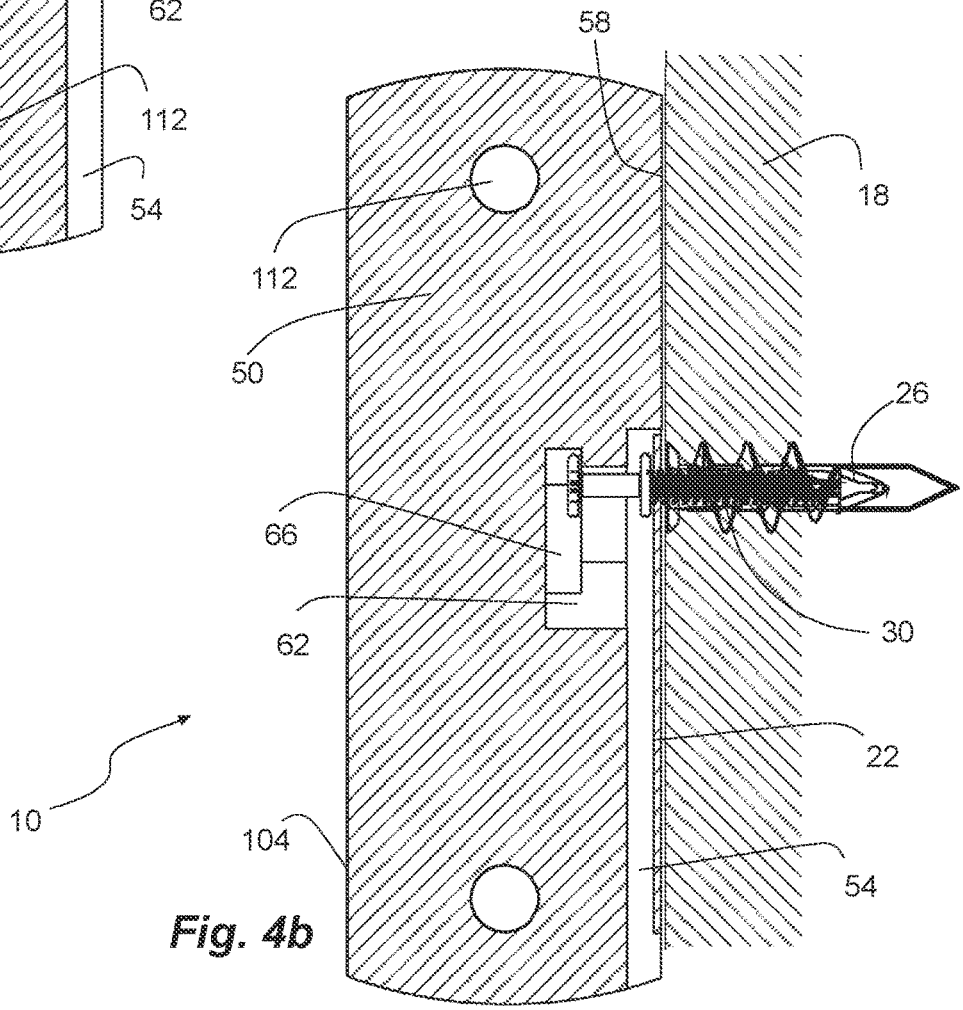
FIG. 4*b* is a cross-sectional, side schematic view of the vertical mount system of FIG. 1*a*, shown mounted to a wall.
Figure 5:
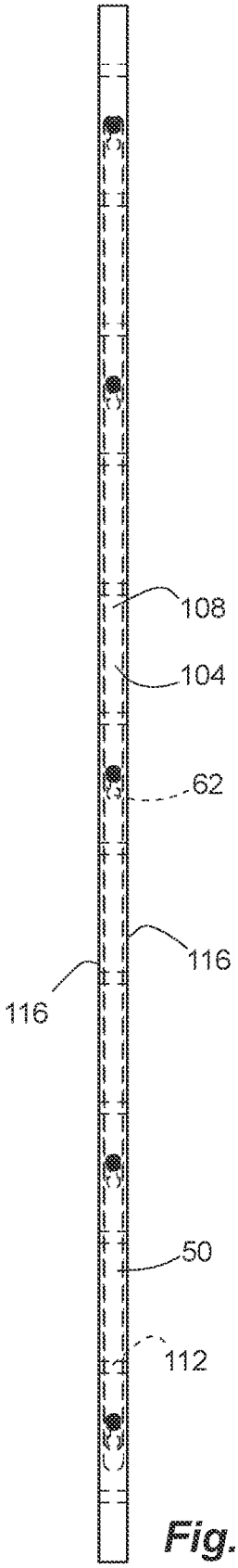
FIG. 5 is a front view of a mounting rail of the vertical mount system of FIG. 1*a*.
Figure 6B:
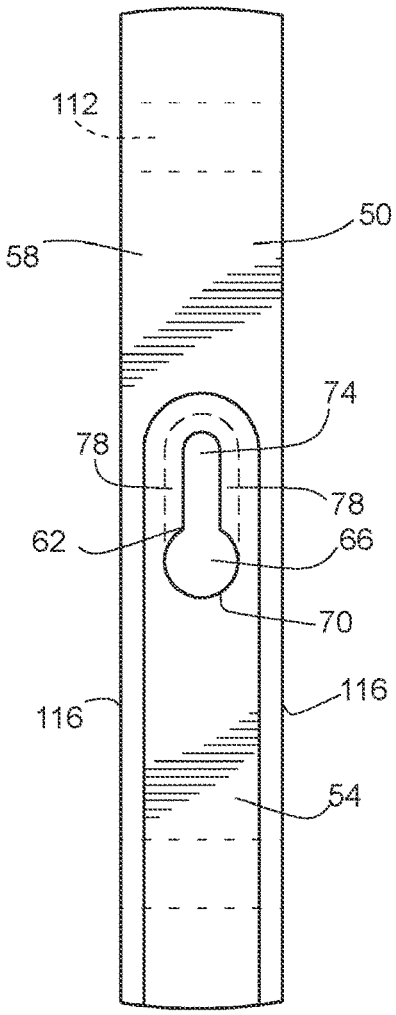
FIG. 6*b* is a partial, detailed, rear view of the mounting rail of the vertical mount system of FIG. 1*a*.
Figure 6A:
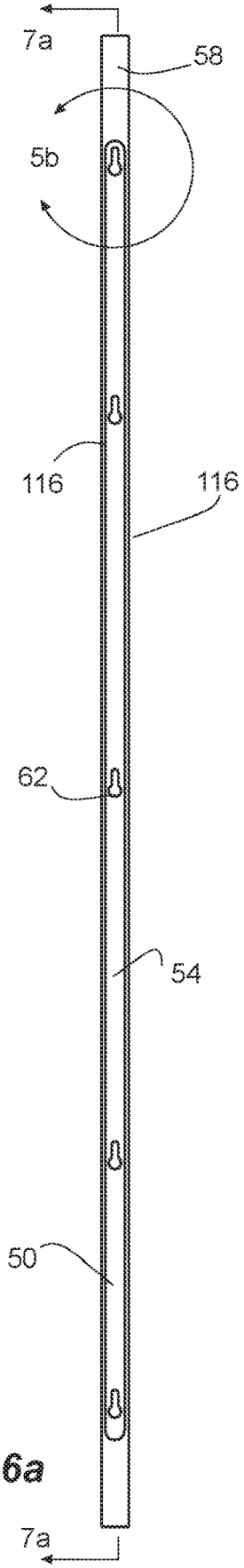
FIG. 6*a* is a rear view of the mounting rail of the vertical mount system of FIG. 1*a*.
Figure 7A:
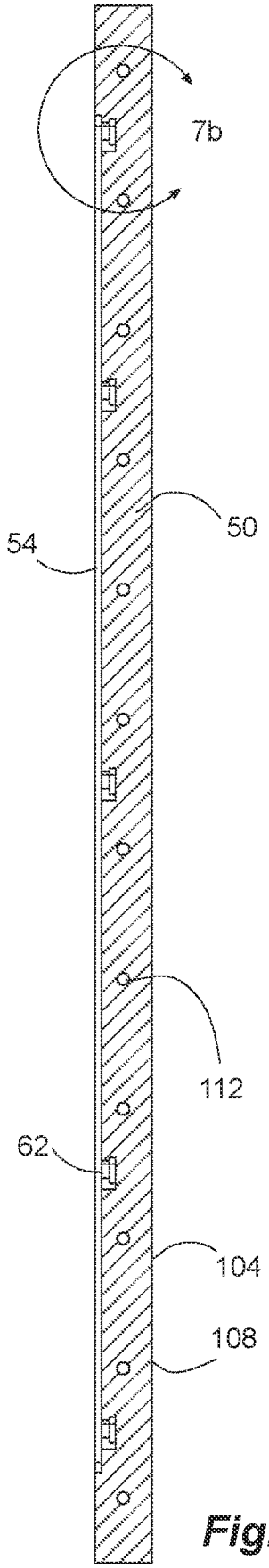
FIG. 7*a* is a cross-sectional side view of the mounting rail of the vertical mount system of FIG. 1*a*, taken along line 7*a* of FIG. 6*a*.
Figure 7B:
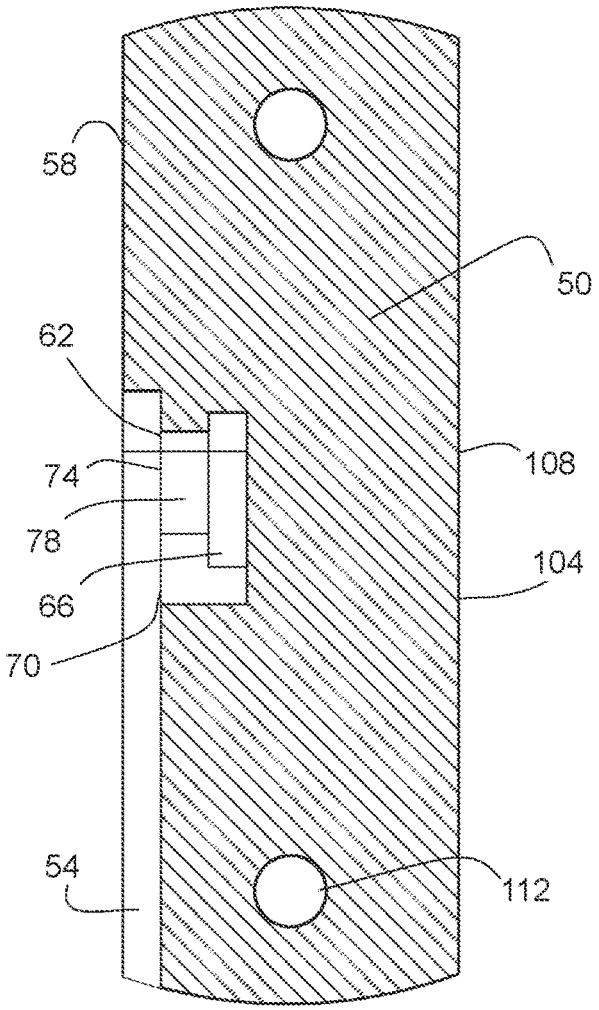
FIG. 7*b* is a partial, detailed, cross-sectional, side view of the mounting rail of the vertical mount system of FIG. 1*a*.

The mounting system 10 can have a plurality of double-headed fasteners 30 corresponding to the array of wall anchors 26 in the wall 18 and the array of apertures 34 in the alignment plate 22. Thus, the double-headed fasteners 30 can be arranged in a vertical array of double-headed fasteners 30. The double-headed fasteners 30 can engage the wall anchors 26, as shown in FIG. 4*b*. The alignment plate 22 can be secured to the wall 18 via the plurality of double-headed fasteners 30 received through the array of apertures 34 and into the array of wall anchors 26. Each double-headed fastener 30 can have an inner head 38 to abut to the alignment plate 22 and an outer head 42 extending from the inner head 38 by a narrower neck 46. The alignment plate 22 can be secured to the wall 18 via the double-headed fasteners 30 received through the array of apertures 34 and into the array of wall anchors 26.

In one aspect, the alignment plate 22 can be placed against the wall 18 and/or the enlarged heads off the wall anchors 26 with the apertures 34 aligned with the wall anchors 26. The double-headed fasteners 30 can be secured to the wall 18 by being driven into the wall anchors 26 until the inner head 38 abuts to the alignment plate 22. For example, the double-headed fasteners 30 can be screwed into the wall anchors 26. A threaded shaft of the double-headed fasteners 30 can separate the bifurcated portions of the wall anchors 26 to further secure or lock the wall anchors 26 to the drywall of the wall 18.

The mounting system 10 can also have a mounting rail 50 associated with the alignment plate 22. The mounting rail 50 can provide a finished surface and can cover and conceal the alignment plate 22, the wall anchors 26 and the double-headed fasteners 30. The mounting rail 50 can be mounted to the wall 18 via the double-headed fasteners 30. The alignment plate 22 can align the double-headed fasteners 30 with the mounting rail 50. The mounting rail 50 can have a recess 54 in a rear 58 of the mounting rail 50 sized and shaped to receive the alignment plate 22 therein, as shown in FIG. 4*b*.

In addition, the mounting rail 50 can have an array of keyholes 62 in the rear 58 of the mounting rail 50, and in the recess 54. The keyholes 62 can be vertically arrayed along a height of the mounting rail 50. Each of the keyholes 62 can have an elongated cavity 66. A larger opening 70 can extend into to the cavity 66. The larger opening 70 can be sized to receive the outer head 42 of the double headed fastener 30. A narrower slot 74 can also extend into the cavity 66 above the larger opening 70. The narrower slot 74 can be contiguous with, and open to, the larger opening 70. The narrower slot 74 can be sized to receive the narrower neck 46 of the double headed fastener 30. A pair of opposite flanges 78 can border the narrower slot 74 to abut to the outer head 42 of the double headed fastener 30. In addition, a top flange can also border the narrower slot 74 to abut to the outer head 42. A longitudinal axis of the keyhole 62 can be aligned with the larger opening 70 and narrower slot 74. The longitudinal axes of the array of keyholes 62 can be vertically aligned and collinear with respect to one another.

In one aspect, the mounting rail 50 can be formed of wood and can be formed by cutting. The mounting rail 50 can have a surface treatment, such as paint or stain.

Figure 8:
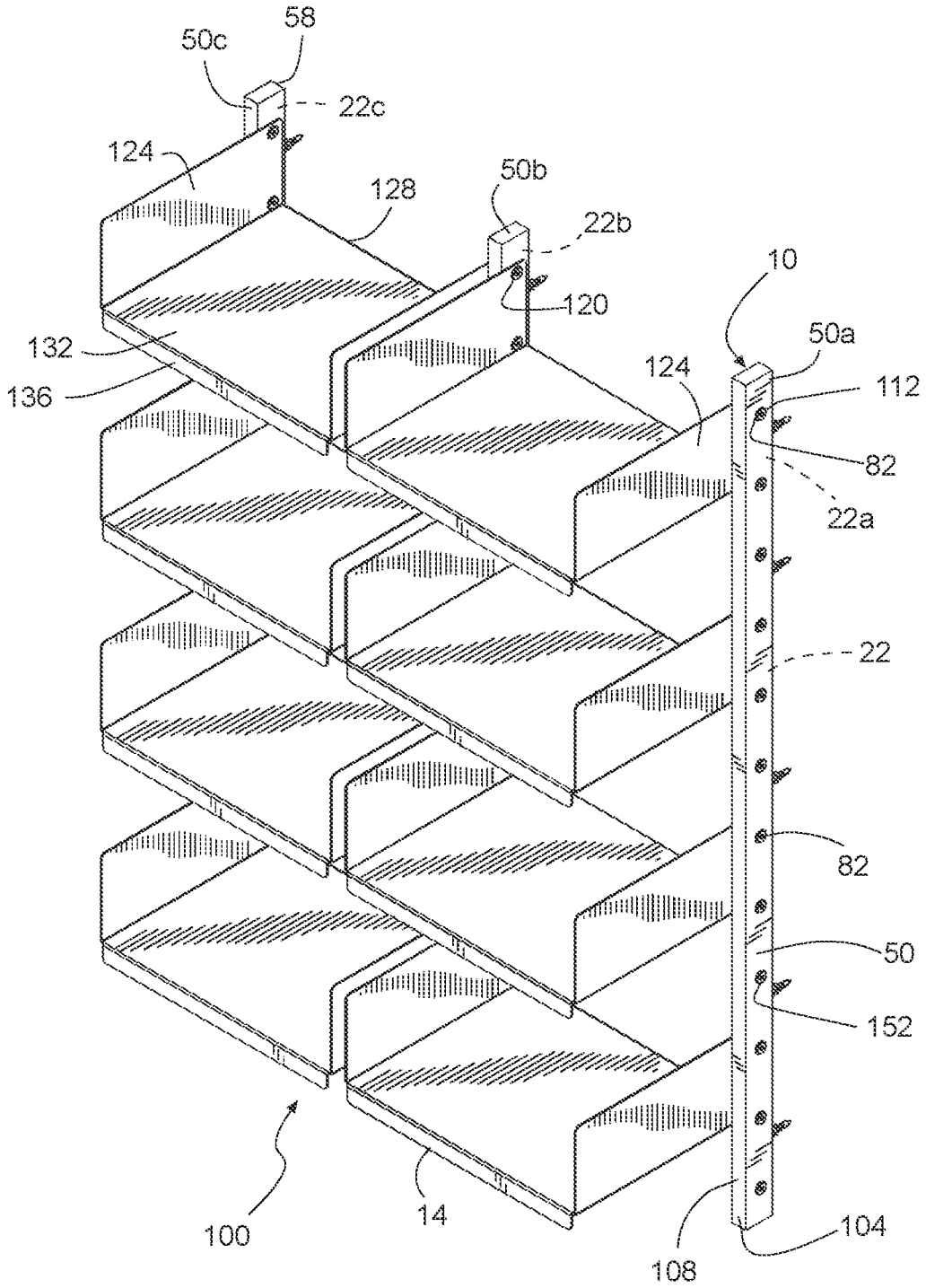
FIG. 8 is a perspective view of a shelf system in accordance with an embodiment an embodiment of the invention shown with the vertical mount system of FIG. 1*a*.
Figure 10:
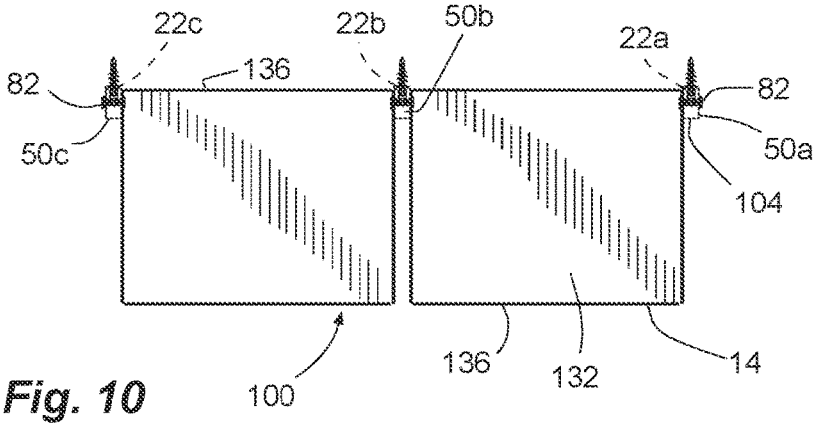
FIG. 10 is a top view of the shelf system of FIG. 8 with the vertical mount system of FIG. 1*a*.
Figure 9:
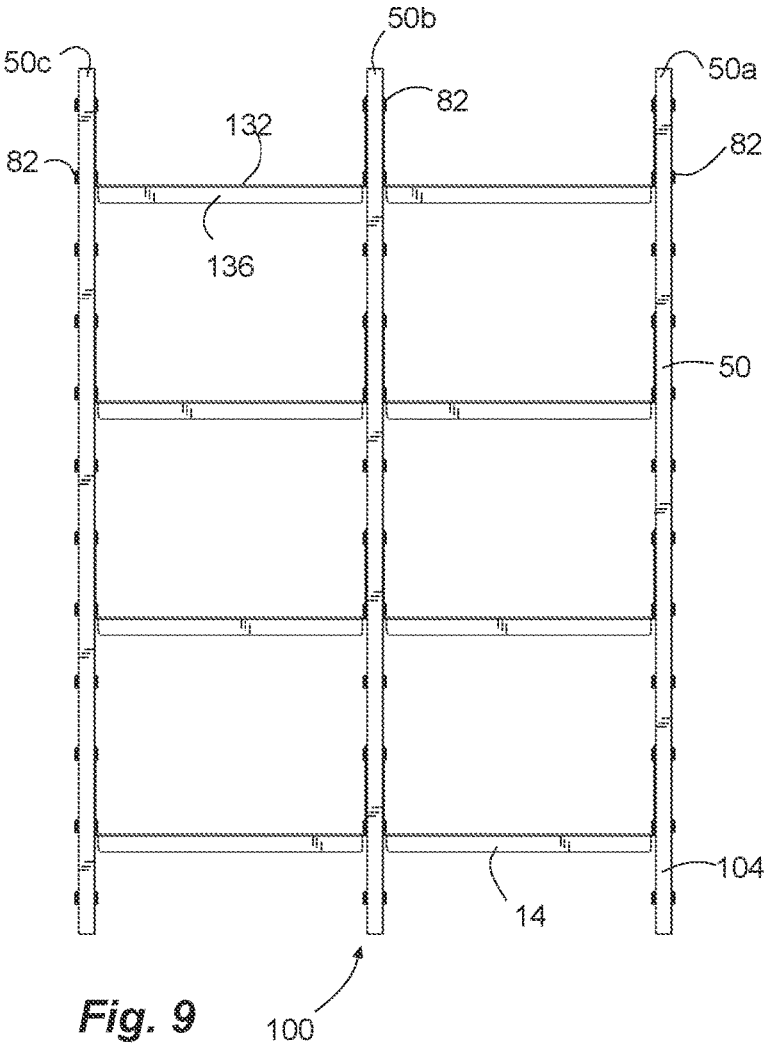
FIG. 9 is a front view of the shelf system of FIG. 8 with the vertical mount system of FIG. 1*a*.
Figure 11:
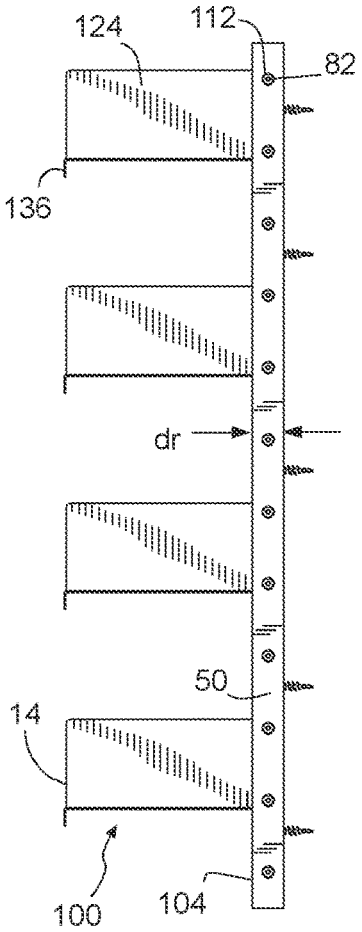
FIG. 11 is a side view of the shelf system of FIG. 8 with the vertical mount system of FIG. 1*a*.
Figure 14:
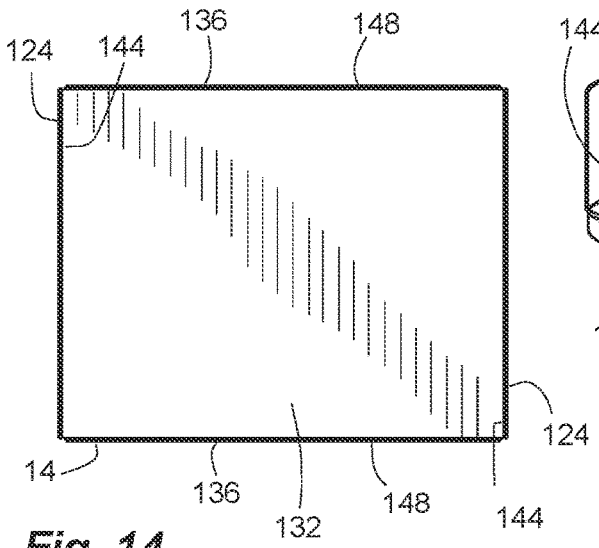
FIG. 14 is a top view of the shelf of FIG. 12.
Figure 12:
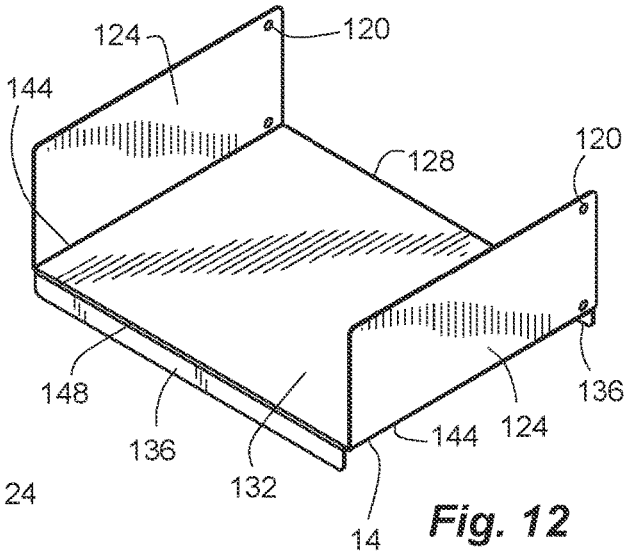
FIG. 12 is a perspective view of a shelf of the shelf system of FIG. 8.

The mounting system 10 can comprise multiple alignment plates 22 and multiple mounting rails 50. For example, the mounting system 10 can comprise a pair of alignment plates 22 and a pair of mounting rails 50, including first and second alignment plates 22*a* and 22*b* and first and second mounting rails 50*a* and 50*b*, as shown in FIGS. 8-10. As another example, the mounting system can comprise three alignment plates 22*a-c* and three mounting rails 50*a-c*, also as shown in FIGS. 8-10. The alignment plates 22 and the mounting rails 50 can be laterally and horizontally spaced-apart from one another. In one aspect, the distance between proximate mounting rails 50 can be the same as a width of the shelves 14. In addition, the alignment plates 22 and the mounting rails 50 can be oriented parallel with respect to one another. The wall hanging and the shelves 14 can be mounted to and between proximate mounting rails 50, such as the first and second mounting rails 50*a* and 50*b*.

A method for hanging and mounting the mount system 10 on and to the wall 18 can comprise placing the alignment plate 22 against a surface of the wall 18 and orienting the alignment plate 22 vertically. In one aspect, the method can comprise positioning a top of the alignment plate 22 with respect to the wall 18 and allowing the alignment plate 22 to hang pendent from the top to vertically orient and plumb the alignment plate 22.

In one aspect, a first double-headed fastener 30*a* can be secured through an upper aperture 34*a* in the alignment plate 22. The alignment plate 22 can hang pendent from the first double-headed fastener 30*a* in the vertical orientation and plumb. In another aspect, the remaining double-headed fasteners 30 can be secured in remaining apertures 34 of the alignment plate 22. In another aspect, marks can be made through the remaining apertures 34 of the alignment plate 22 on the wall 18 for locations of the wall anchors 26.

In another aspect, the method can comprise marking the surface of the wall 18 through the array of apertures 34 in the alignment plate 22 with an array of marks. The alignment plate 22 can be removed from the wall 18. The plurality of wall anchors 26 can be secured to the wall 18 at locations corresponding to the array of marks to form the vertical array of anchors 26. The alignment plate 22 can be placed against the surface of the wall 18 with the array of apertures 34 aligned with the array of wall anchors 26. The plurality of double-headed fasteners 30 can be secured to the wall 18 through the array of apertures 34 and into the array of wall anchors 26 to form a vertical array of double-headed fasteners 30.

This process can be repeated for the remaining alignment plates 22 with the alignment plates 22, the arrays of wall anchors 26 and the arrays of double-headed fasteners 30 spaced-apart from one another. For example, a second alignment plate 22*b* can be placed against the surface of the wall 18 spaced-apart from the first alignment plate 22*a*. The second alignment plate 22*b* can be oriented vertically and parallel with respect to the first alignment plate 22*a*. A second plurality of double-headed fasteners 30 can be secured to the wall 18 through the array of apertures 34 in the second alignment plate 22*b* to form a second vertical array of double-headed fasteners 30.

The method can further comprise securing the mounting rail 50 to the wall 18 with the array of keyholes 62 in the mounting rail 50 receiving the array of double-headed fasteners 30. In addition, the recess 54 of the mounting rail 50 can receive the alignment plate 22. Furthermore, the rear 58 of the mounting rail 50 can abut to the surface of the wall 18. Thus, the mounting rail can conceal the alignment plate 22, the double-headed fasteners 30 and the wall anchors 26.

In one aspect, the array of keyholes 62 in the mounting rail 50 can be aligned to the array of double-headed fasteners 30. The mounting rail 50 can be moved horizontally towards the wall 18 and with the outer heads 42 of the double-headed fasteners 30 extending into the larger openings 70 in the array of keyholes 62, and with the recess 54 of the mounting rail 50 receiving the alignment plate 22, until the rear 58 of the mounting rail 50 abuts to the surface of the wall 50. The mounting rail 50 can be moved downwardly with outer heads 42 of the double-headed fasteners 30 extending into the narrower slots 74 in the array of keyholes 62, and with the narrower necks 46 of the double headed-fasteners 30 extending between the pair of opposite flanges 78 of the keyholes 62.

The process can be repeated for the remaining mounting rails 50 with the mounting rails 50 spaced-apart from one another.

The wall hanging and shelves 14 can be secured to the mounting rail(s) 50. In one aspect, the wall hanging and shelves 14 can be secured laterally to the mounting rails 50 with lateral sides of the wall hanging of shelf 14 secured to the lateral sides of the mounting rails 50 with lateral fasteners 82. In another aspect, the wall hanging and shelf 14 can extend between the lateral sides of proximate mounting rails 50.

Referring to FIGS. 8-24, a shelf system 100 to be mounted to the wall 18 (FIG. 4*b*) in an example of the invention is shown. The shelf system 100 can be utilized with and mounted to the wall 18 by the mount system 10 and mounting rails 50 described herein. The shelf system 100 can provide a plurality of shelves 14 in various different configurations. In one aspect, a vertical array of shelves 14 can be provided in a column and mounted to the wall 18. In another aspect, a horizontal array of shelves 14 can be provided in a row and mounted to the wall 18. In another aspect, a horizontal and vertical matrix of shelves 14 can be provided rows and columns and mounted to the wall 18. In another aspect, a variety of different shelves 14 can be provided with different sizes and/or shapes to accommodate different wall areas and/or different items to be carried by the shelves 14.

The shelf system 100 can comprise mounting rails 50 mounted to the wall 18. In one aspect, at least one mounting rail 50 can be used. In another aspect, multiple mounting rails 50 can be used, such as a pair of mounting rails, including first and second mounting rails 50*a* and 50*b*, or three mounting rails 50*a-c*. The mounting rails 50 can be elongated and vertically oriented. In another aspect, the mounting rails 50 can be mounting rails as described herein.

The mounting rails 50 can have a solid front face 104 with a continuous surface 108. The mounting rails 50 can have an array of bores 112 extending laterally into and arrayed vertically along the lateral sides 116 of the mounting rails 50. In one aspect, the bores 112 can extend laterally through the mounting rail 50. In another aspect, the bores 112 can be blind bores that extend into, but not through, the mounting rail 50.

The shelf system 100 can also comprise shelves 14 coupled to the mounting rails 50. In one aspect, at least one shelf 14 can be coupled to the at least one mounting rail 50. Each shelf 14 can have a lateral aperture 120 on each lateral side 124. The lateral aperture 120 of the shelf 14 can align with a bore 112 of the mounting rail 50. Fasteners 82 can extend laterally through the lateral apertures 120 in the shelves 14 and the bores 112 of the array of bores in the mounting rails 50. In one aspect, each shelf 14 can have a pair of lateral apertures 120 vertically arranged on each lateral side 124. Each pair of apertures 120 can align with a corresponding pair of bores 112 in the mounting rail 50. Thus, the shelf 14 can be coupled to the mounting rail 50 via the pair of apertures 120 and the array of bores 112.

In one aspect, a rear 128 of the shelf 14 can abut to the wall 18 and can be coplanar with the rear 58 of the mounting rails 50. In another aspect, the shelf 14 can have a depth ds greater than a depth dr of the mounting rail 50. Thus, the shelf 14 can protrude forward and beyond the mounting rail 50. The shelves 14 can be cantilevered from the mounting rails 50.

The shelves 14 can have a horizontal platform 132 to receive items, such as books, pictures, collectables, etc. A pair of lateral sides 124 can extend vertically from the lateral sides of the horizontal platform 132. In one aspect, the lateral sides 124 can extend upward from the horizontal platform 132 to form ends of the shelf 14, such as bookends. The lateral apertures 120 can be formed in the lateral sides 125. In one aspect, a lateral aperture 120 can be located at a top of the lateral wall and another lateral aperture 120 can be located at a bottom of the lateral wall proximate the horizontal platform 132 to reduce torque from the cantilevered shelf 14. A pair of longitudinal tabs 136 can extend vertically from longitudinal sides (i.e. a front and a back) of the horizontal platform 132. In one aspect, the longitudinal tabs 136 can extend downward to provide an uninterrupted view and/or access into the shelf 14 and the horizontal platform 132. The longitudinal tabs 136 can provide structural strength to the horizontal platform 132.

In another aspect, the shelf 14 can be formed by a single plate 140 (FIG. 16) with constant thickness that is cut and bent to form the horizontal platform 132, the pair of lateral sides 124 and the pair of longitudinal tabs 136. A pair of lateral bends 144 can be formed between the horizontal platform 132 and the pair of lateral sides 124 to provide strength. Similarly, a pair of longitudinal bends 148 can be formed between the horizontal platform 132 and the pair of longitudinal tabs 136 to provide strength. The continuous structure of the horizontal platform 132, the lateral sides 126 and the longitudinal tabs 136 can increase the strength and rigidity of the shelf 14.

Figure 13:
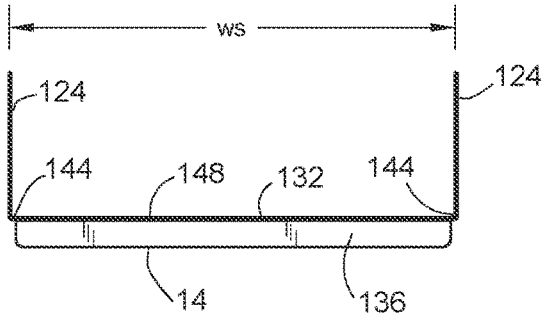
FIG. 13 is a front view of the shelf of FIG. 12.
Figure 15:
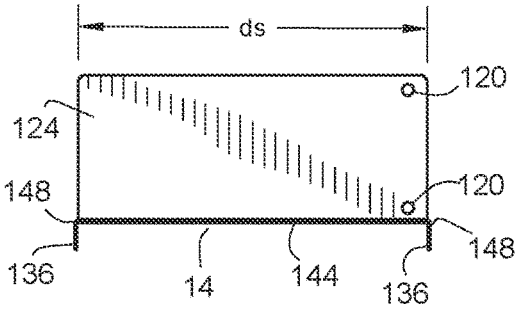
FIG. 15 is a side view of the shelf of FIG. 12.
Figure 16:
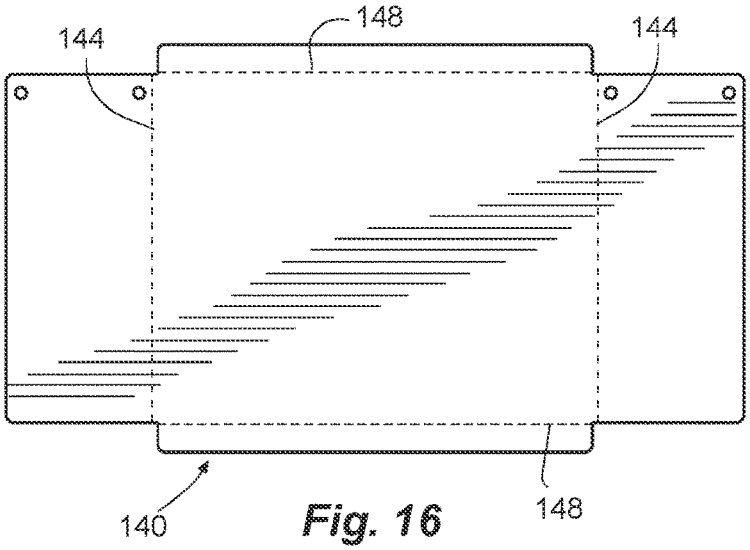
FIG. 16 is a top view of a plate used to form the shelf of FIG. 12.
Figure 18:
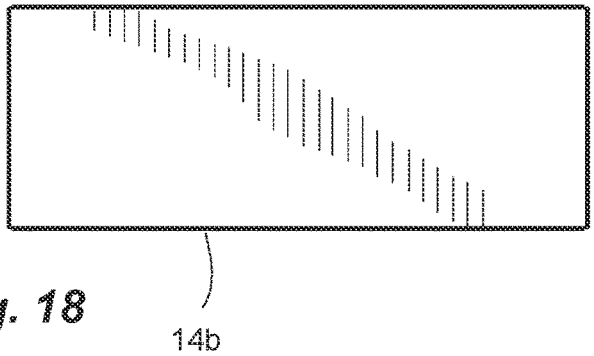
FIG. 18 is a top view of the shelf of FIG. 17.
Figure 17:
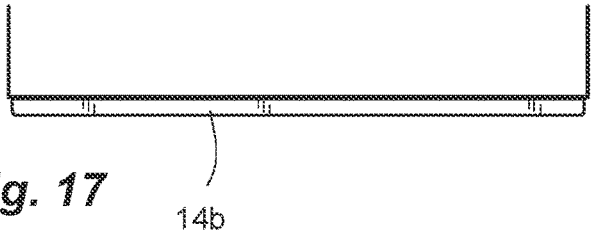
FIG. 17 is a front view of another shelf of the shelf system of FIG. 8.
Figure 19:
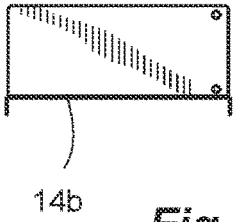
FIG. 19 is a side view of the shelf of FIG. 17.
Figure 20:
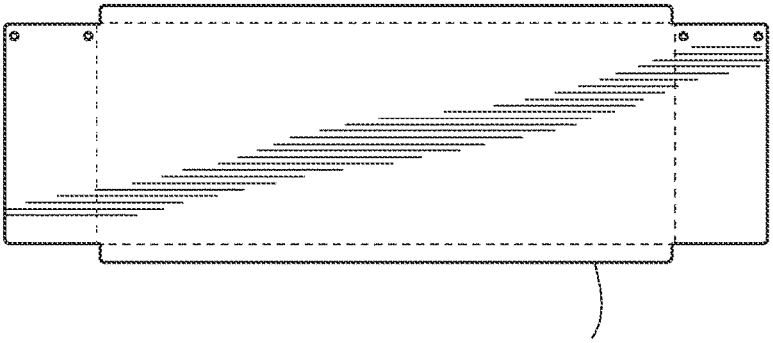
FIG. 20 is a top view of a plate used to form the shelf of FIG. 17.
Figure 22:
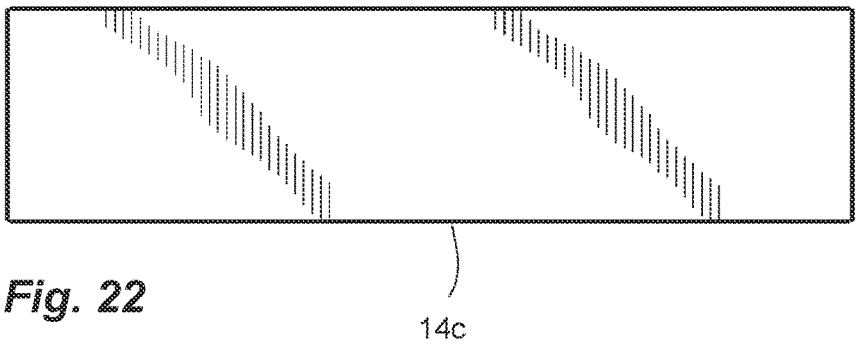
FIG. 22 is a top view of the shelf of FIG. 21.
Figure 21:
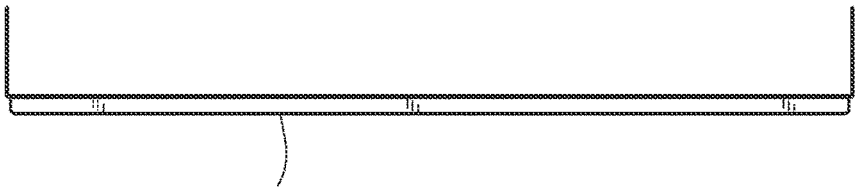
FIG. 21 is a front view of another shelf of the shelf system of FIG. 8.
Figure 23:
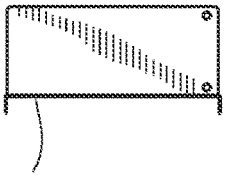
FIG. 23 is a side view of the shelf of FIG. 21.
Figure 24:
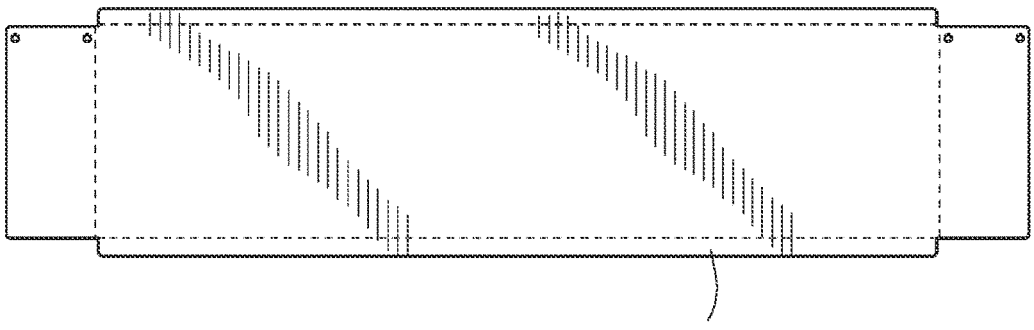
FIG. 24 is a top view of a plate used to form the shelf of FIG. 21.

In one aspect, the shelf 14 can have a greater surface area in lateral elevation view (FIG. 15) than a lesser surface area in longitudinal elevation view (FIG. 13). Thus, the lateral sides 126 can provide strength and rigidity while the longitudinal tabs 136 can allow viewing and access to the horizontal platform 132.

In another aspect, the shelf system 100 can have the front face 104 of the mounting rails 50 be clear of the shelves 14 for an unimpeded front elevation exposure (FIG. 9). Thus, the solid front face 104 and continuous surface 108 can be exposed to draw attention to the lack of mounting hardware.

As discussed herein, the shelf system 100 can have a pair of mounting rails 50, including first and second mounting rails 50*a* and 50*b*. The mounting rails 50*a* and 50*b* can be vertically oriented and parallel with respect to one another. In addition, the mounting rails 50*a* and 50*b* can be spaced-apart from one another. The shelves 14 can be coupled to and between the pair of mounting rails 50*a* and 50*b*. Thus, the shelves 14 can be positioned between the pair of mounting rails 50*a* and 50*b*, and the front faces 104 of the pair of mounting rails 50*a* and 50*b* can be exposed alongside the shelves 14.

Also as discussed herein, the shelf system 100 can have three mounting rails 50*a-c* spaced-apart from one another, including a center mounting rail 50*b*. A pair of shelves 14 can be coupled to the three mounting rails 50*a-c* with each shelf 14 positioned between a proximate pair of mounting rails 50*a* and 50*b* and 50*b* and 50*c*. The front face 104 of the center mounting rail 50*b* can be exposed between the pair of shelves 14.

A method for mounting the shelf system 100 can comprise mounting the pair of mounting rails 50 to the wall in a vertical orientation. In addition, the mounting rails 50 can be spaced-apart a distance equal to a lateral width ws of the shelves 14. A shelf 14 can be positioned between the first and second mounting rails 50*a* and 50*b*. A first lateral aperture 120 in a first side 124 of the shelf 14 can be aligned with a first lateral bore 112 of a first array of bores extending laterally from and arrayed vertically along the first mounting rail 50*a*. A first fastener 82 can be inserted laterally through the first lateral aperture 120 and the first lateral bore 112.

A second lateral aperture 120 in a second side 124 of the shelf 14 can be aligned with a second lateral bore 112 of a second array of bores extending laterally from and arrayed vertically along the second mounting rail 50. A second fastener 82 can be inserted laterally through the second lateral aperture 120 and the second lateral bore 112.

In one aspect, filler fasteners 152 can be inserted into the unused bores 112 of the mounting rails 50 for a constant appearance and inconspicuous appearance.

In one aspect, the alignment plate 22 can have a vertical height of approximately 41¼ inches, a width of approximately ¼ inches, and a depth of approximately 1/16 inches. The alignment plate 22 can be made from metal, such as bar stock.

In one aspect, the mounting rails 50 can have a vertical height of approximately 48 inches, a width of approximately ⅞ inches; and a depth of approximately 1¾ inches. The lateral bores 112 of the mounting rails 50 can be spaced-apart 4 inches on center. The mounting rails 50 can be formed of wood and can a surface treatment, such as stain or paint, as desired. The keyholes can be milled into the wood.

In one aspect, the shelf 14 can have dimensions that are approximately 12 inches deep, approximately 15 inches wide, lateral sides 124 that are approximately 5 inches high, longitudinal tabs 136 that are approximately 1 inch high, and total shelf height of approximately 6 inches. The lateral apertures 120 in the shelf 14 can be spaced-apart 4 inches on center. The shelf 14 can be formed from sheet metal that is cut and bent to form the shelf.

Referring to FIGS. 17-20, another shelf 14*b* is shown that is similar in many respects to those described herein, but which can have different dimensions. The shelf 14*b* can have a width of approximately 31 inches.

Referring to FIGS. 21-24, another shelf 14*c* is shown that is similar in many respects to those described herein, but which can have different dimensions. The shelf 14*c* can have a width of approximately 47 inches.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left." "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A vertical mount system configured for wall hangings, the system comprising:

a wall mounting fastener alignment plate that is elongated and vertically oriented;

an array of apertures vertically arrayed along a height of the wall mounting fastener alignment plate;

a plurality of wall anchors corresponding to the array of apertures and configured to be arranged in a vertical array of wall anchors;

a plurality of double-headed fasteners corresponding to the array of apertures and configured to be arranged in a vertical array of double-headed fasteners and configured to engage the plurality of wall anchors, each double-headed fastener having an inner head configured to abut to the wall mounting fastener alignment plate and an outer head extending from the inner head by a narrower neck;

the wall mounting fastener alignment plate configured to position the plurality of wall anchors with respect to a wall in the vertical array of wall hangers;

the wall mounting fastener alignment plate configured to be secured to the wall via the plurality of double-headed fasteners received through the array of apertures and into the array of wall anchors;

a mounting rail associated with the wall mounting fastener alignment plate and having a rear;

a recess in the rear of the mounting rail sized and shaped to receive the wall mounting fastener alignment plate therein;

an array of keyholes in the rear of the mounting rail and vertically arrayed along a height of the mounting rail, the array of keyholes configured to receive the outer heads of the plurality of double-headed fasteners to mount the mounting rail to the wall, the array of keyholes having:

an elongated cavity; a larger opening to the cavity sized to receive the outer head of a double headed fastener; a narrower slot to the cavity contiguous with the larger opening and sized to receive the narrower neck of the double headed fastener; a pair of opposite flanges bordering the narrower slot and configured to abut to the outer head of the double headed fastener; and a longitudinal axis aligned with the larger opening and narrower slot; and the longitudinal axes of the array of keyholes being vertically aligned and collinear with respect to one another.

2. The vertical mount system in accordance with claim 1, wherein the wall mounting fastener alignment plate is a first wall mounting fastener alignment plate; wherein the mounting rail is a first mounting rail; and further comprising:

a second wall mounting fastener alignment plate spaced-apart from the first wall mounting fastener alignment plate and oriented parallel with respect to one another; and a second mounting rail associated with the first wall mounting fastener alignment plate.

3. The vertical mount system in accordance with claim 2, further in combination with the wall and a wall hanging, and further comprising:

the first and second wall mounting fastener alignment plates being secured to the wall;

the first and second mounting rails secured to and hanging from the first and second wall mounting fastener alignment plates, respectively; and the wall hanging mounted to the first and second mounting rails.

4. The vertical mount system in accordance with claim 1, further in combination with the wall, and further comprising:

the plurality of wall anchors secured to the wall and arranged in the vertical array of wall anchors; and the wall mounting fastener alignment plate secured to the wall via the plurality of double-headed fasteners received through the array of apertures and into the array of wall anchors.

5. A method for hanging the mount system in accordance with claim 1 on the wall, the method comprising:

placing the wall mounting fastener alignment plate against a surface of the wall;

orienting the wall mounting fastener alignment plate vertically;

marking the surface of the wall through the array of apertures in the wall mounting fastener alignment plate with an array of marks;

removing the wall mounting fastener alignment plate from the wall;

securing the plurality of wall anchors to the wall at locations corresponding to the array of marks to form a vertical array of anchors;

placing the wall mounting fastener alignment plate against the surface of the wall with the array of apertures aligned with the array of wall anchors;

securing the plurality of double-headed fasteners to the wall through the array of apertures in the wall mounting fastener alignment plate and into the array of wall anchors to form a vertical array of double-headed fasteners;

aligning an array of keyholes in the mounting rail to the array of double-headed fasteners;

moving the mounting rail horizontally towards the wall with outer heads of the double-headed fasteners extending into the larger openings in the array of keyholes, and with the recess of the mounting rail receiving the wall mounting fastener alignment plate, until the rear of the mounting rail abuts to the surface of the wall; and moving the mounting rail downwardly with the outer heads of the double-headed fasteners extending into the narrower slots in the array of keyholes.

6. The method in accordance with claim 5, the method comprising:

securing a wall hanging to the mounting rail.

7. A vertical mount system configured for wall hangings, the system comprising:

a pair of wall mounting fastener alignment plates that are configured to be mounted to a wall, spaced-apart from one another, and vertically oriented;

each wall mounting fastener alignment plate comprising:

an array of apertures vertically arrayed along a height of the wall mounting fastener alignment plate;

a plurality of double-headed fasteners corresponding to the array of apertures and configured to be arranged in a vertical array of double-headed fasteners, each double-headed fastener having an inner head configured to abut to the wall mounting fastener alignment plate and an outer head extending from the inner head by a narrower neck; and the wall mounting fastener alignment plate configured to be secured to the wall via the plurality of double-headed fasteners received through the array of apertures.

8. The vertical mount system in accordance with claim 7, wherein the wall mounting fastener alignment plate is a first wall mounting fastener alignment plate, and further comprising:

a second wall mounting fastener alignment plate spaced-apart from the first wall mounting fastener alignment plate and oriented parallel with respect to one another.

9. The vertical mount system in accordance with claim 7, further comprising:

a pair of mounting rails associated with the pair of wall mounting fastener alignment plates;

each mounting rail comprising:

a recess in a rear of the mounting rail sized and shaped to receive the wall mounting fastener alignment plate therein;

an array of keyholes in the rear of the mounting rail and vertically arrayed along a height of the mounting rail, the array of keyholes having:

an elongated cavity; a larger opening to the cavity sized to receive the outer head of a double headed fastener; a narrower slot to the cavity contiguous with the larger opening sized to receive the narrower neck of the double headed fastener; a pair of opposite flanges bordering the narrower slot and configured to abut to the outer head of the double headed fastener; and a longitudinal axis aligned with the larger opening and narrower slot; and the longitudinal axes of the array of keyholes being vertically aligned and collinear with respect to one another.

10. The vertical mount system in accordance with claim 9, further comprising:

a plurality of wall anchors corresponding to the array of apertures and configured to be arranged in a vertical array of wall anchors; and the wall mounting fastener alignment plates configured to position the plurality of wall anchors with respect to a wall in the vertical array of wall hangers.

11. A method for hanging the system in accordance with claim 10 on the wall, the method comprising:

placing the wall mounting fastener alignment plate against a surface of the wall;

orienting the wall mounting fastener alignment plate vertically;

marking the surface of the wall through the array of apertures in the wall mounting fastener alignment plate with an array of marks;

removing the wall mounting fastener alignment plate from the wall;

securing the plurality of wall anchors to the wall at locations corresponding to the array of marks to form a vertical array of anchors;

placing the wall mounting fastener alignment plate against the surface of the wall with the array of apertures aligned with the array of wall anchors;

securing the plurality of double-headed fasteners to the wall through the array of apertures and into the array of wall anchors to form a vertical array of double-headed fasteners;

aligning an array of keyholes in the mounting rail to the array of double-headed fasteners;

moving the mounting rail horizontally towards the wall with outer heads of the double-headed fasteners extending into larger openings in the array of keyholes, and with the recess of the mounting rail receiving the wall mounting fastener alignment plate, until the rear of the mounting rail abuts to the surface of the wall; and moving the mounting rail downwardly with outer heads of the double-headed fasteners extending into narrower slots in the array of keyholes.

12. A method for mounting on a wall, the method comprising:

placing a wall mounting fastener alignment plate against a surface of the wall;

orienting the wall mounting fastener alignment plate vertically;

securing a plurality of double-headed fasteners to the wall through an array of apertures in the wall mounting fastener alignment plate to form a vertical array of double-headed fasteners; and securing a mounting rail to the wall with an array of keyholes in the mounting rail receiving the array of double-headed fasteners, with a recess of the mounting rail receiving the wall mounting fastener alignment plate, and with a rear of the mounting rail abutting to the surface of the wall.

13. The method in accordance with claim 12, wherein vertically orienting the wall mounting fastener alignment plate and securing the plurality of double-headed fasteners further comprises:

positioning a top of the wall mounting fastener alignment plate with respect to the wall;

securing a first double-headed fastener through an upper aperture in the wall mounting fastener alignment plate with the wall mounting fastener alignment plate pendent from the first double-headed fastener in a vertical orientation; and securing remaining double-headed fasteners in remaining apertures of the wall mounting fastener alignment plate.

14. The method in accordance with claim 12, wherein further comprising:

marking the surface of the wall through the array of apertures in the wall mounting fastener alignment plate with an array of marks after placing the wall mounting fastener alignment plate against the surface of the wall and prior to securing the plurality of double-headed fasteners;

removing the wall mounting fastener alignment plate from the wall;

securing a plurality of wall anchors to the wall at locations corresponding to the array of marks to form a vertical array of anchors;

placing the wall mounting fastener alignment plate against the surface of the wall with the array of apertures aligned with the array of wall anchors; and securing the plurality of double-headed fasteners through the array of apertures and into the array of wall anchors.

15. The method in accordance with claim 12, wherein further comprising:

aligning the array of keyholes in the mounting rail to the array of double-headed fasteners;

moving the mounting rail horizontally towards the wall with outer heads of the double-headed fasteners extending into larger openings in the array of keyholes, and with the recess of the mounting rail receiving the wall mounting fastener alignment plate, until the rear of the mounting rail abuts to the surface of the wall; and moving the mounting rail downwardly with outer heads of the double-headed fasteners extending into narrower slots in the array of keyholes.

16. The method in accordance with claim 12, further comprising:

securing a wall hanging to the mounting rail.

17. The method in accordance with claim 12, wherein the wall mounting fastener alignment plate is a first wall mounting fastener alignment plate, and further comprising:

placing a second wall mounting fastener alignment plate against the surface of the wall spaced-apart from the first wall mounting fastener alignment plate;

orienting the second wall mounting fastener alignment plate vertically and parallel with respect to the first wall mounting fastener alignment plate;

securing a second plurality of double-headed fasteners to the wall through an array of apertures in the second wall mounting fastener alignment plate to form a second vertical array of double-headed fasteners; and securing a second mounting rail to the wall with an array of keyholes in the second mounting rail receiving the second array of double-headed fasteners, with a recess of the second mounting rail receiving the second wall mounting fastener alignment plate, and with a rear of the second mounting rail abutting to the surface of the wall.

18. The method in accordance with claim 17, further comprising:

securing a wall hanging to and between the first and second mounting rails.

19. A method for hanging a wall hanging on a wall, the method comprising:

placing a wall mounting fastener alignment plate against a surface of the wall;

vertically orienting the wall mounting fastener alignment plate;

marking the surface of the wall through the array of apertures in the wall mounting fastener alignment plate with an array of marks;

removing the wall mounting fastener alignment plate from the wall;

securing the plurality of wall anchors to the wall at locations corresponding to the array of marks to form a vertical array of anchors;

placing the wall mounting fastener alignment plate against the surface of the wall with the array of apertures aligned with the array of wall anchors;

securing the plurality of double-headed fasteners to the wall through the array of apertures and into the array of wall anchors to form a vertical array of double-headed fasteners;

aligning an array of keyholes in the mounting rail to the array of double-headed fasteners;

moving the mounting rail horizontally towards the wall with outer heads of the double-headed fasteners extending into larger openings in the array of keyholes, and with the recess of the mounting rail receiving the wall mounting fastener alignment plate, until the rear of the mounting rail abuts to the surface of the wall;

moving the mounting rail downwardly with outer heads of the double-headed fasteners extending into narrower slots in the array of keyholes; and securing the wall hanging to the mounting rail.

20. The method in accordance with claim 19, wherein the wall mounting fastener alignment plate is a first wall mounting fastener alignment plate, and further comprising:

placing a second wall mounting fastener alignment plate against the surface of the wall spaced-apart from the first wall mounting fastener alignment plate;

orienting the second wall mounting fastener alignment plate vertically and parallel with the first wall mounting fastener alignment plate; and securing a second plurality of double-headed fasteners to the wall through an array of apertures in the second wall mounting fastener alignment plate to form a second vertical array of double-headed fasteners.

* * * * *